US005771958A

United States Patent [19]

Sears, Jr.

[11] Patent Number: 5,771,958

[45] Date of Patent: Jun. 30, 1998

[54] MOLD FOR CONTINUOUS CASTING SYSTEM

[75] Inventor: James Bernard Sears, Jr., Riverview, Mich.

[73] Assignee: AG Industries, Inc., Coraopolis, Pa.

[21] Appl. No.: 528,401

[22] Filed: Sep. 14, 1995

[51] Int. Cl.[6] ..... B22D 11/04

[52] U.S. Cl. ..... 164/443; 164/485

[58] Field of Search ..... 164/443, 485

[56] References Cited

U.S. PATENT DOCUMENTS

| | | | |
|---|---|---|---|
| 2,169,893 | 8/1939 | Crampton et al. . | |
| 2,862,265 | 12/1958 | Vaughn et al. . | |
| 2,893,080 | 7/1959 | Goss . | |
| 3,511,305 | 5/1970 | Wertli . | |
| 3,528,487 | 9/1970 | Wognum et al. . | |
| 3,763,920 | 10/1973 | Auman et al. . | |
| 3,978,910 | 9/1976 | Gladwin . | |
| 4,182,397 | 1/1980 | Schmucker et al. | 164/443 |
| 4,535,832 | 8/1985 | Sevastakis | 164/421 |
| 4,640,337 | 2/1987 | Sevastakis | 164/443 |
| 5,117,895 | 6/1992 | Hargassner et al. | 164/418 |
| 5,201,909 | 4/1993 | Von Wyl et al. | 164/418 |
| 5,207,266 | 5/1993 | Nakashima et al. | 164/348 |

FOREIGN PATENT DOCUMENTS

| | | | |
|---|---|---|---|
| 51-8124 | 1/1976 | Japan | 164/443 |
| 60-250856 | 12/1985 | Japan | 164/443 |
| 3-35850 | 2/1991 | Japan | 164/443 |
| 952422 | 8/1982 | U.S.S.R. | 164/443 |
| 248912 | 8/1986 | U.S.S.R. | 164/443 |

*Primary Examiner*—J. Reed Batten, Jr.
*Attorney, Agent, or Firm*—Woodcock Washburn Kurtz Mackiewicz & Norris LLP

[57] ABSTRACT

The mold includes an outer wall that has a plenum chamber defined in an inner surface thereof and at least one passage for communicating the plenum chamber with an external coolant conduit. The mold further includes a liner that is secured to the inner surface of the outer wall. The liner has a number of slots defined in an inner wall thereof which, together with the outer wall, define a number of passages for transporting coolant to cool the liner during operation of the mold. A recess intersecting at least one of the slots is provided in the inner wall of the liner. A restrictor plate is situated in the recess, and serves to strategically reduce the cross-section of selected slots in order to achieve the desired coolant flow profile among the slots. The mold may further include a velocity plate that is positioned between the plenum and the transition portion to limit an opening by which coolant may flow between the plenum and the transition portion. The velocity plate has a tapered cutout portion defined in a side thereof that faces the transition portion. The combined effect of the cutout portion and the transition portion is to define a flowpath that induces a substantially constant, elevated coolant flow velocity throughout the entire mold, prolonging the life of the mold.

19 Claims, 7 Drawing Sheets

MOLD FOR CONTINUOUS CASTING SYSTEM

BACKGROUND OF THE INVENTION

1. Field of the Invention

This invention relates broadly to the field of metal production and casting. More specifically, this invention relates to an improved mold for a continuous casting system that has a longer useful life, improves the uniformity of heat removal, and turns out a better product than conventional continuous casting molds do.

2. Description of the Prior Art

A conventional continuous casting mold includes a number of liner plates, usually made of copper, and outer walls surrounding the liner plates. The liner plates define a portion of the mold that contacts the molten metal during the casting process. Parallel vertically extending water circulation slots or passageways are provided between the outer walls and the liner plates to cool the liner plates. During operation, water is introduced to these slots, usually at the bottom end of the mold, from a water supply via an inlet plenum that is in communication with all of the slots in a liner plate. The cooling effect so achieved causes an outer skin of the molten metal to solidify as it passes through the mold. The solidification is then completed after the semi-solidified casting leaves the mold by spraying additional coolant, typically water, directly onto the casting. This method of metal production is highly efficient, and is in wide use in the United States and throughout the world.

Briefly referring to FIG. 4, both the top and bottom ends of each slot or passageway 22 are conventionally radiused into the plenum 14 at a transition portion 28 in order to minimize flow resistance. Considering that plenum 14 extends along an entire side of a liner plate 20 while the slots 22 are spaced periodically, the plenum 14 is relatively large in a cross-section taken along a normal to the flow direction of the water when compared to the combined cross-sections of the slots 22. As a result, water flow velocity in the plenum area 14 and in the adjacent transition portion 28 tends to be materially less than the water flow velocity in the main portion of the slots 22. In one calculation that was done by the inventor, flow velocity in the plenum area was found to be 2–3 feet per second, while the flow rate in the main portion of the slots was estimated at 20–30 feet per second, a ten-fold difference. This flow velocity differential causes the liner plate to be cooled more effectively at its center than at its top and the bottom. In fact, the low velocity area at the top of a liner plate has, even when positioned adjacent to the meniscus of the molten metal in the mold, been measured to have as high a temperature than areas that are about two inches below the meniscus, when, if the cooling effect was even, it would be expected to have a lower temperature. This uneven cooling effect causes expansion stresses that substantially limit the life of the liner plates.

This invention solves the velocity problem by interposing a velocity plate between the plenum and the transition portion of the slot. The velocity plate increases the velocity of the coolant water at the top and the bottom of the liner plate.

In addition, coolant distribution among the slots must be optimized in order to assure an absence of steep temperature gradients on the mold face.

Ideally, only the very top and bottom ends of the slot 22 in a conventional mold should be radiused, and it would be a fairly small radius. The mold that is disclosed in U.S. Pat. No. 3,763,920 to Auman et al. ("Auman") shows a relatively small radius. However, in practice the slot ends tend to end up with a much longer radius, as is shown in FIG. 4, because the slots 22 are cut into the liner plate 20 by a side mill cutter that has a relatively large diameter. This is almost certainly the case in real-world embodiments of the Auman mold. Auman also discloses a dispersion plate that is positioned between its plenum and cooling slots to break the momentum of the inflowing water and equalize flow rate among the different slots. In practice, the water flow in an Auman mold would be impeded because of the narrow gap that is defined between the dispersion plate and the larger-radius transition portion of the cooling slots that the mold would be likely to have. A need exists, then, to ensure that the velocity plate in this invention does not have similar problems.

SUMMARY OF THE INVENTION

It is an object of the invention to provide an improved mold for continuous metal casting that provides a more balanced cooling effect than has heretofore been achieved by conventional molds.

It is further an object of the invention to provide such an improved mold without creating flow impediment problems of the type that would likely be encountered in a design such as Auman's.

It is yet further an object of the invention to provide an improved method of retrofitting a mold so as to achieve the benefits discussed above.

It is also an object of the invention to provide an improved mold, or a method of retrofitting an existing mold, in order to assure an optimum distribution of coolant among the different cooling slots.

In order to achieve the above and other objects of the invention, an improved mold for a continuous casting process according to a first aspect of the invention includes an outer wall having a plenum chamber defined in an inner surface thereof and at least one passage for communicating the plenum chamber with an external coolant conduit; a liner that is secured to the inner surface of the outer wall, the liner having a number of slots defined in an inner wall thereof which, together with the outer wall, define a number of passages for transporting coolant to cool the liner during operation of the mold, the inner wall further having a recessed area defined therein; and a restrictor situated in the recessed area of the liner for reducing a cross-sectional area of at least one of said slots, whereby a desired distribution of coolant among the slots is achieved.

According to a second aspect of the invention, an improved mold for a continuous casting process includes four outer walls, each of which has a plenum chamber defined in an inner surface thereof and at least one passage for communicating the plenum chamber with an external coolant conduit; four liner walls, each of the liner walls being secured to the inner surface of one of the outer walls, the liner walls together defining a mold surface through which molten material may be passed and shaped, each of the liners having a number of slots defined in an inner wall thereof which, together with the outer wall, define a number of passages for transporting coolant to cool the liner during operation of the mold, at least one of the inner walls further having a recessed area defined therein; and restrictor means situated in the recessed area of the liner for reducing a cross-sectional area of at least one of the slots, whereby a desired distribution of coolant among the slots is achieved.

According to a third aspect of the invention, a method of retrofitting a continuous casting mold of the type that includes an inner liner having a number of coolant passages defined therein and a plenum that is in communication with the passages, the passages having a transition portion that decreases in cross-section proximate the plenum, includes steps of:(a) separating the mold elements to expose the inner liner and its slots; (b) forming a recessed area in the inner liner, the recessed area intersecting at least one of the slots; (c)inserting a restrictor plate into the recessed area, thereby reducing the cross-sectional area of at least one of the slots; and (c) resealing the mold with the restrictor plate mounted therein.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
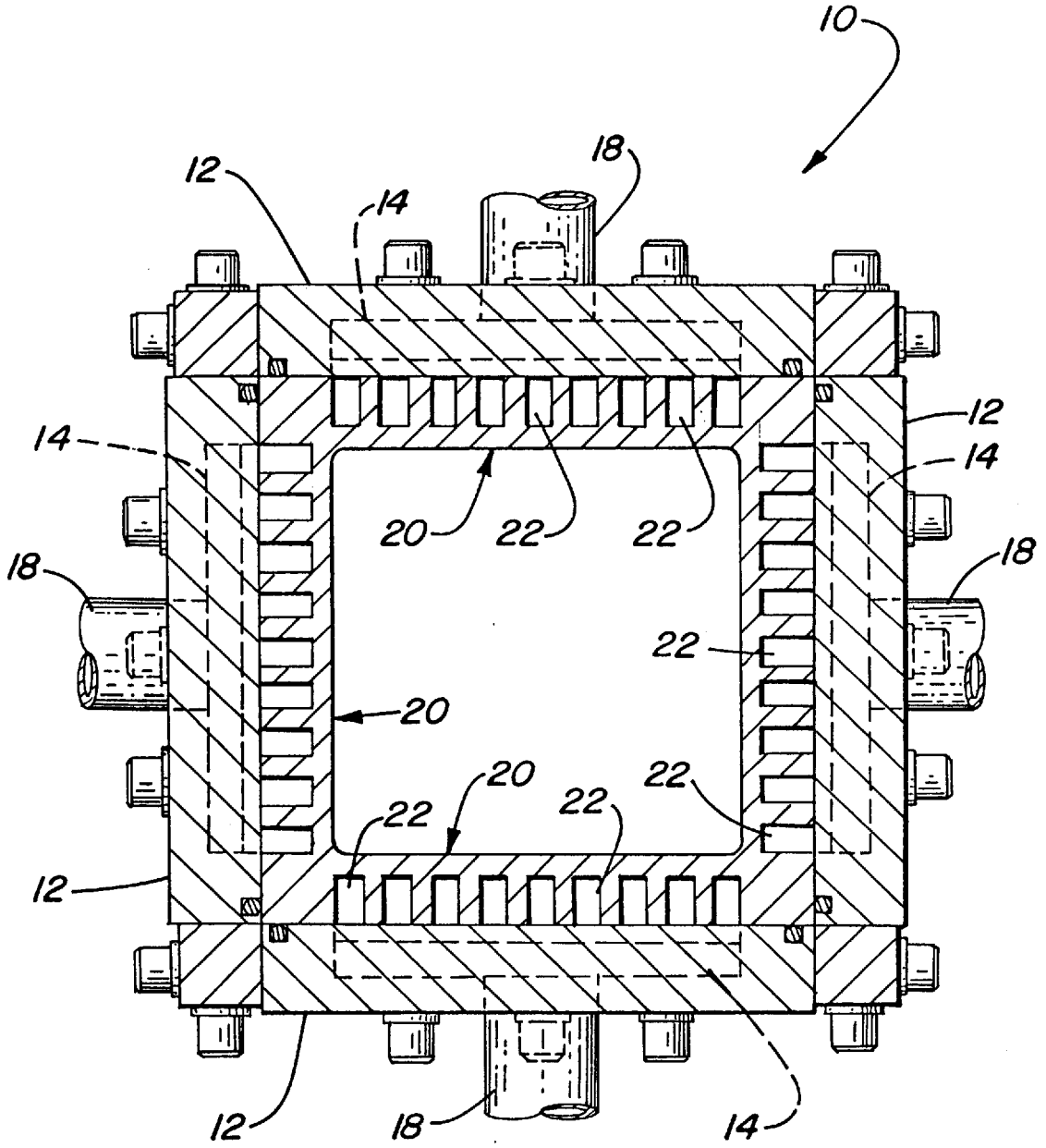
FIG. 1 is a cross-sectional fragmentary top view of an improved continuous casting mold that is constructed according to a first embodiment of the invention.
Figure 5:
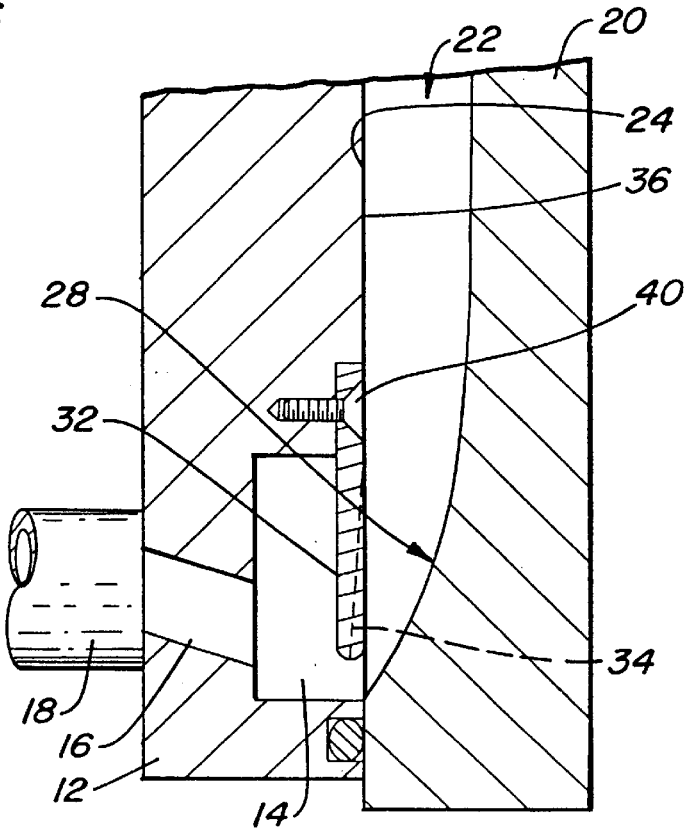
FIG. 5 is a fragmentary cross-sectional view of a portion of the mold that is depicted in FIGS. 1–3, corresponding to FIG. 4.

Referring now to the drawings, wherein like reference numerals designate corresponding structure throughout the views, and referring in particular to FIG. 1, an improved continuous casting mold 10 that is constructed according to a preferred embodiment of the invention includes four outer walls 12 that each have a plenum 14 defined therein, as may be seen in FIG. 5. Each of the outer walls 12 further has a passage 16 defined therein, as may also be seen in FIG. 5, to communicate plenum 14 with a external conduit of coolant, which in the preferred embodiment is a water inlet supply pipe 18.

Figure 6:
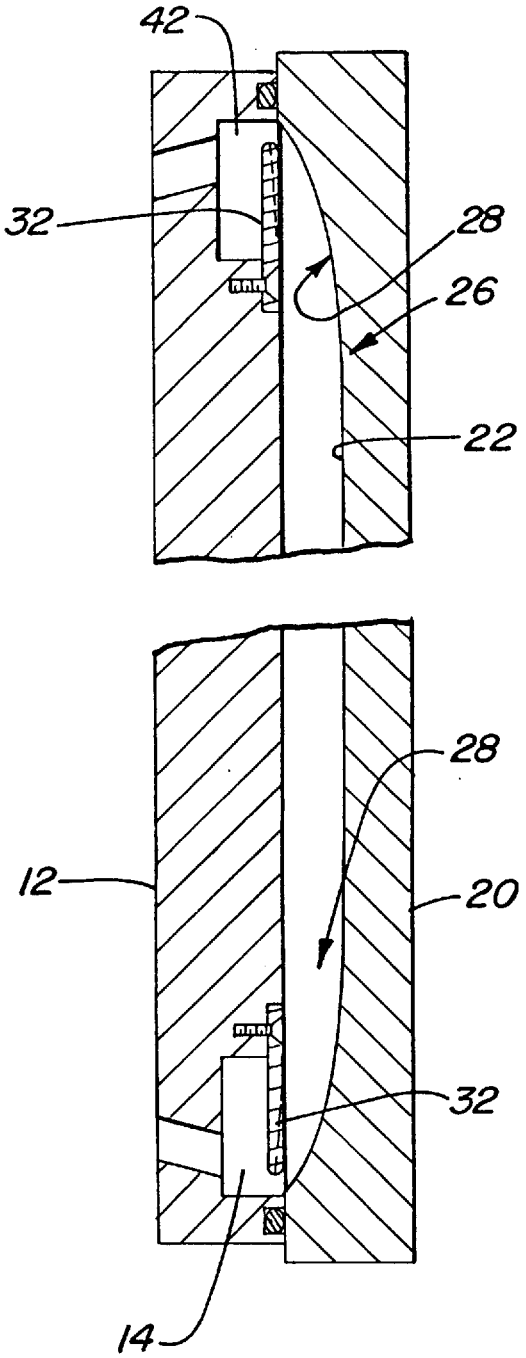
FIG. 6 is a fragmentary cross-sectional view of another portion of the mold that is depicted in FIGS. 1–3 and 5.

Continuous casting mold 10 also includes four liner walls 20, each of which is secured to an inner surface 36, respectively, of an outer wall 12, as may best be seen in FIGS. 1 and 5. The liner walls 20 together define a mold surface through which molten material such as steel may be passed and shaped, as is well known in this area of technology. Each liner 20 or liner plate is preferably fabricated from a material that has high thermal connectivity, preferably copper, as is also well known in this technical area. As may be seen in FIG. 1, each liner wall 20 has a number of slots 22 defined in an inner surface 24 thereof which, together with the respective outer wall 12, defines a number of passages 26, shown in FIG. 6, for transporting coolant such as water to cool the liner 20 during operation of the mold 10.

As may best be seen in FIG. 5, each of the slots 22 has a radiused transition portion 28 that is proximate to a location where slot 22 communicates with the plenum 14. As is also depicted in FIG. 5, the transition portion 28 decreases in cross section as the slot 22 nears the plenum 14. The radius of the transition portion 28 is fairly large, for the reasons that are discussed above in the discussion of the problems that are associated with the prior art.

Figure 4:
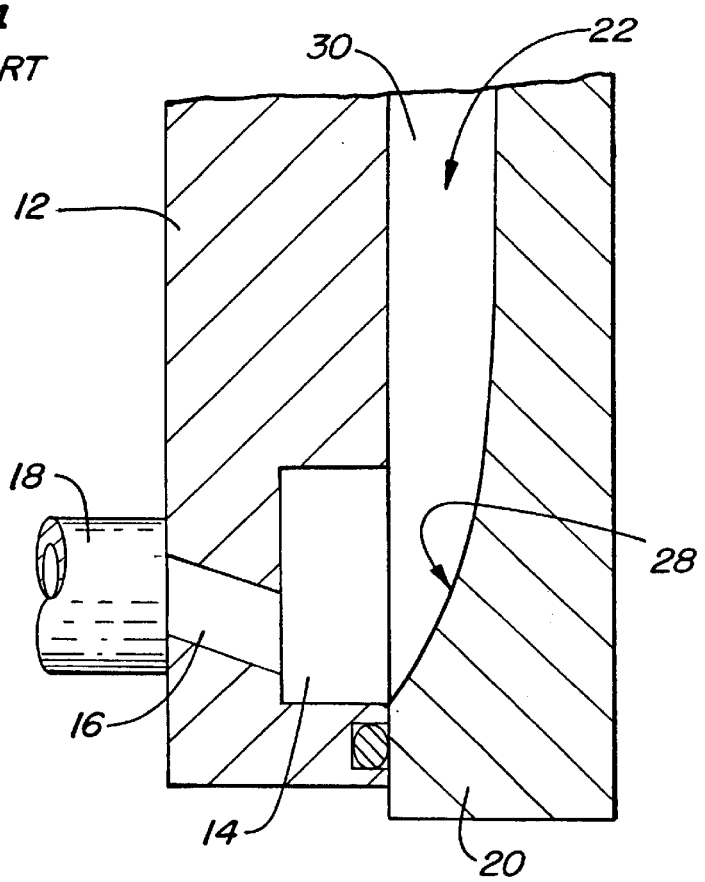
FIG. 4 PRIOR ART
FIG. 4 is a fragmentary cross-sectional view of a portion of a conventional continuous casting mold.

FIG. 4 depicts a conventional mold, which also includes a plenum 14, a slot 22 and a radiused transition portion 28 that has a relatively large diameter. For the reasons discussed above, the water velocity in the plenum chamber and by the radius transition portion 28 is relatively low in comparison to that in a high velocity region 30 of the slot 22.

Figure 2:
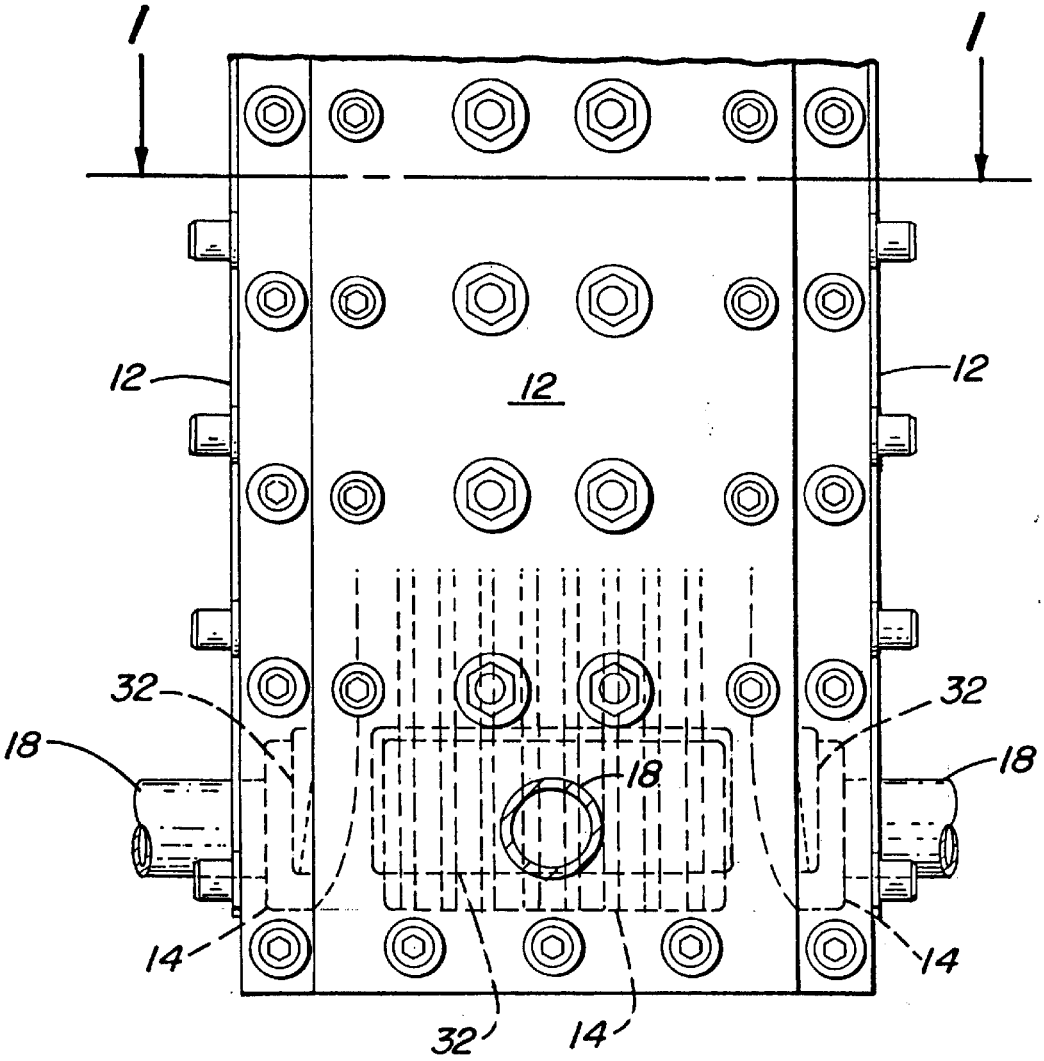
FIG. 2 is a fragmentary side elevational view of the casting mold depicted in FIG. 1, with certain internal components illustrated by hidden lines.
Figure 3:
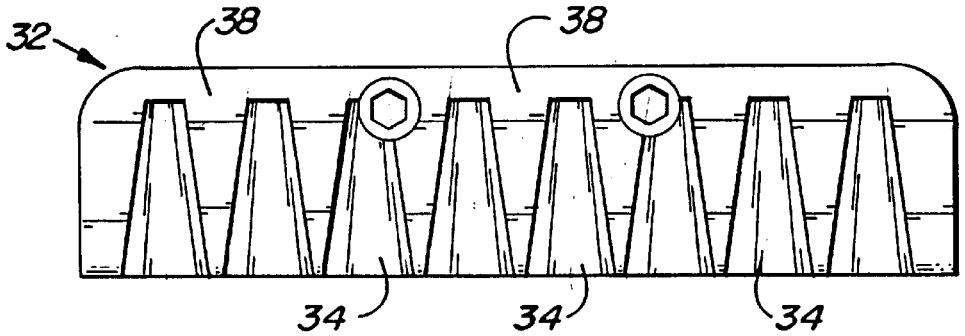
FIG. 3 is a side elevational view of a component of the mold that is depicted in FIGS. 1 and 2.

Referring again to FIG. 5, one important aspect of the invention involves the provision of a velocity plate 32 that is positioned between the plenum 14 and the transition portion 28 of the slot 22. Velocity plate 32 functions to limit an opening through which coolant may flow between plenum 14 and transition portion 28, thereby increasing the velocity of coolant flow at this point. Because of the large radius of the transition portion 28, velocity plate 32 would create a significant impediment to water flow between the plenum 14 and the slot 22, if it were not for the provision of a number of tapered cutout portions 34 that are defined in a side of velocity plate 32 that faces the transition portion 28 of slot 22. Looking briefly to FIGS. 2 and 3, it will be seen that a cutout portion 34 is provided on velocity plate 32 for each of the slots 22 that are define in the liner plate 20. The cutout portions 34 are depicted in FIG. 3 in contrast to the flat portions 38.

Velocity plate 32 is preferably secured to outer wall 12 by means of a bolt that presents substantially no resistance to coolant flow, such as the flat head bolt 40 that is depicted in FIG. 5.

Looking again to FIG. 5, it will be seen that the gap between velocity plate 32 and radiused transition portion 28 is less at the bottom of the velocity plate 32 than it is at the top of the velocity plate 32. However, as may be seen in FIG. 3, each of the cutout portions 34 in velocity plate 32 is substantially wider at the bottom of the velocity plate 32 than at the top of the velocity plate 32. This has the effect of maintaining a substantially uniform cross section, in a direction that is normal to the flow of coolant during operation, from the plenum 14 to the top of the region that is bounded by velocity plate 32 and transition portion 28, into the main portion of the slot 22. As a result, flow velocity remains relatively constant from the point the water leaves plenum 14 to the main portion of the slot 22. Preferably, this will be within the range of substantially 20 feet per second to about 30 feet per second. As a result, the cooling rate along this portion liner 20 will be relatively even, minimizing stresses and prolonging the life of the liner 20.

The invention also embraces a method of retrofitting a continuous casting mold of the type described above by separating the mold elements to expose the plenum and the transition portion, securing a velocity plate of the type described above between the plenum and the transition portion, and resealing the mold with the velocity plate mounted therein. This method can readily be envisioned by comparing FIG. 4 and 5.

Referring now to FIGS. 7–12, an improved mold 60 that is constructed according to a second embodiment of the invention for a continuous casting process includes a mold liner 62 that is secured to an inner surface of an outer wall, as is described above. As may be seen in FIGS. 7 and 8, liner 62 has a number of slots 64, 66, 68 defined in an inner wall 72 thereof which, together with the outer wall, define a number of passages for transporting coolant to cool the liner 62 during operation of the mold 60. As may be seen in FIGS. 7 and 12, bolt holes 70 are also defined in the inner wall 72 of the liner 62.

Figure 7:
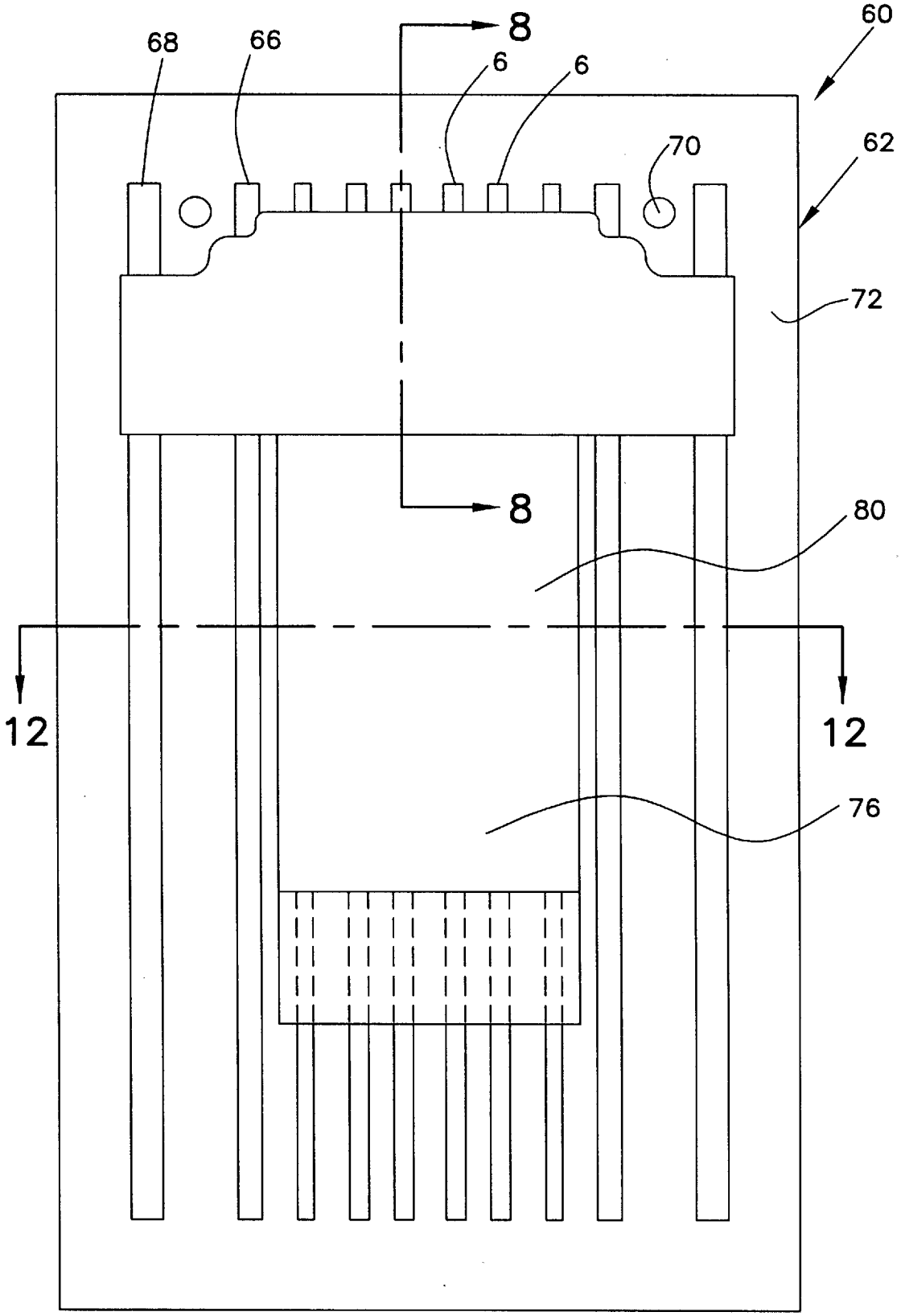
FIG. 7 is an elevational view of a mold liner, a restrictor plate and a velocity plate on a continuous casting mold that is constructed according to a second, preferred embodiment of the invention.
Figure 12:
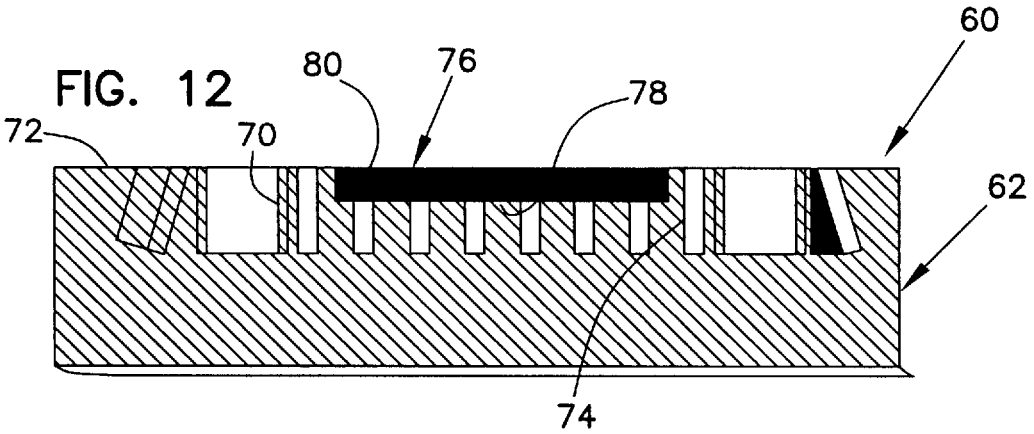
FIG. 12 is a cross-sectional view taken along lines 12—12 in FIG. 7.

According to this embodiment, a recessed area 74, which is preferably shaped in a form of a rectangle, is defined in the inner wall 72 of the liner 62, as is best visible in FIGS. 7 and 12. A restrictor, which in the preferred embodiment is a restrictor plate 76, is situated in the recessed area 74 for reducing a cross-sectional area of at least one of the slots 64 that are defined in the inner wall 72 of liner 62. As may be seen in the cross-sectional view that is provided in FIG. 8, restrictor plate 76 has an inner surface 78 that, together with the walls of slot 64, defines a restricted passage through which coolant may flow, this passage having a depth that is less than a slot 66 that is not bounded by restriction plate 76. Restrictor plate 76 further includes an outer surface 80 that is substantially flush with the inner wall 72 of the liner 62, as may be seen in FIG. 12.

Referring again to FIG. 8, it will be seen that each of the slots 64 has a radiused transition portion 82 that is proximate to a location where the slot 64 communicates with the plenum. The transition portion 82 decreases in cross-section near the plenum. Advantageously, restrictor plate 76 has grooves 84 defined therein that are intended to communicate with the slots 64 and are configured to increase in cross-section at at least one end thereof to correct for the decreasing cross-section of the slots at the transition portion 82. Accordingly, a passage of nearly uniform cross-section is achieved at the end of the restrictor plate 76, resulting in uniform velocity, and uniform cooling of the mold face.

Figure 8:
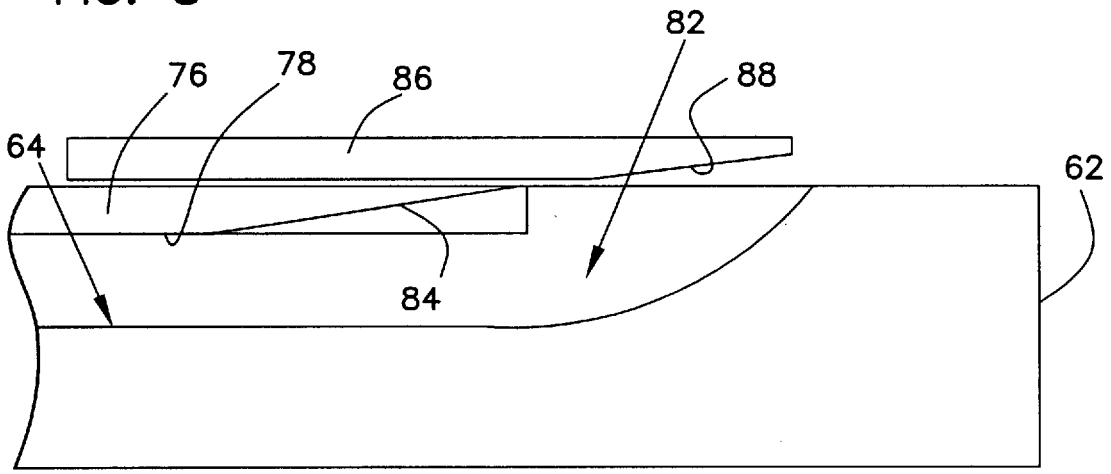
FIG. 8 is a cross-sectional view taken along lines 8—8 in FIG. 7.
Figure 9:
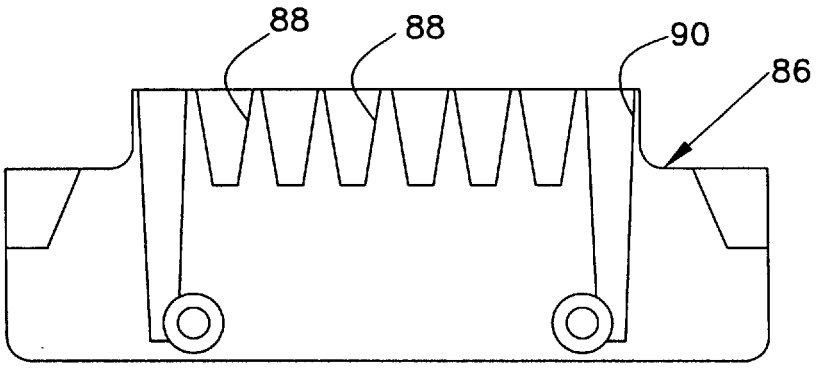
FIG. 9 is an elevational view of one side of the velocity plate depicted in FIG. 7.
Figure 10:
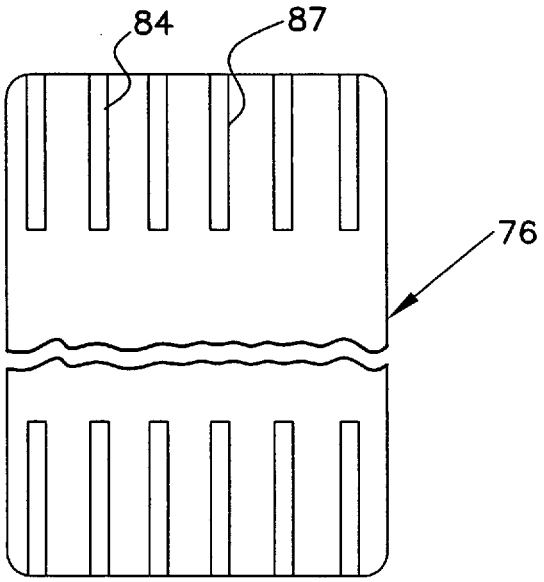
FIG. 10 is an elevational view of the restrictor plate depicted in FIG. 7.
Figure 11:
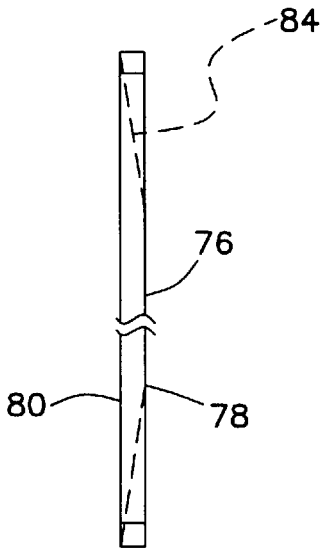
FIG. 11 is a side elevational view of the restrictor plate shown in FIG. 10.

A velocity plate 86 is preferably used in conjunction with the restrictor plate 76 in the manner that is shown in FIGS. 7, 8 and 9. Velocity plate 86 is, as the velocity plate described above is, positioned between the plenum and transition portion 82 to limit an opening by which coolant may flow between the plenum and the transition portion 82. Velocity plate 86 has a number of tapered cutout portions 88 that are defined in a side thereof that faces the transition portion 82 of each of the slots 64, beyond the end of the restrictor plate. This is best shown in FIG. 8. The cutout portion 88 is tapered so as to increase in cross section toward the distal end of the velocity plate 86, as the depth of the transition portion 82 decreases, to keep the overall cross-sectional area of the end of the slot 64 relatively uniform, and thus the velocity of the coolant moving therethrough relatively uniform as well. This, again, provides more uniform cooling to the very top and the very bottom of the mold face. Velocity plate 86 also includes tapered cutout portions 90 for slots that are not restricted by the restrictor plate 76.

Although FIG. 7 shows a velocity plate mounted to only the top of the mold 60, it is to be understood that a velocity plate is preferably positioned at both the top and the bottom of the mold. Even cooling, of course, is most important at the top of the mold, where the meniscus is and where the metal skin first begins to solidify. In addition, it is to be understood that the velocity plate and the restrictor plate could be fabricated together as a single integrated component within the scope of the invention.

The invention according to the second embodiment also embraces a method of retrofitting a continuous casting mold of the type that is described above. The method involves separating the mold elements to expose the inner liner and the slots, forming a recessed area in the inner liner that intersects at least one of the slots, inserting a restrictor plate into the recessed area to reduce the cross-sectional area of at least one of the slots, and resealing the mold with the restrictor plate mounted therein.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. An improved mold for a continuous casting process, comprising:

an outer wall, said outer wall having a plenum chamber defined in an inner surface thereof and at least one passage for communicating said plenum chamber with an external coolant conduit;

a liner that is secured to said inner surface of said outer wall, said liner having a number of slots defined in an inner wall thereof which, together with said outer wall, define a number of passages for transporting coolant to cool said liner during operation of said mold, said inner wall further having a recessed area defined therein; and restrictor means situated in said recessed area of said liner for reducing a cross-sectional area of at least one of said slots, whereby a desired distribution of coolant among said slots is achieved.

2. A mold according to claim 1, wherein said restrictor means comprises a restrictor plate that resides in said recessed area, said restrictor plate having an inner surface that is faced toward said recessed area of said liner and the slots therein, and an oppositely facing outer surface.

3. A mold according to claim 2, wherein said outer surface of said restrictor plate is substantially flush with said inner wall of said liner.

4. A mold according to claim 2, wherein each of said slots has a radiused transition portion that is proximate to a location where said slot communicates with said plenum chamber, said transition portion decreasing in cross-section near said plenum chamber, and said restrictor plate has grooves defined therein that are intended to communicate with said slots and are configured to increase in cross-section at at least one end thereof to correct for the decreasing cross-section of the slots at the transition portion, whereby a passage of nearly uniform cross-section is achieved.

5. A mold according to claim 4, further comprising a velocity plate positioned between said plenum chamber and said transition portion to limit an opening by which coolant may flow between said plenum chamber and said transition portion, said velocity plate having a tapered cutout portion defined therein in a side thereof that faces said transition portion.

6. A continuous casting mold according to claim 1, wherein said plenum chamber is an inlet plenum.

7. A continuous casting mold according to claim 1, wherein said plenum chamber is an outlet plenum.

8. A continuous casting mold according to claim 5, wherein said cutout portion is tapered to increase in width in a direction toward said opening.

9. A continuous casting mold according to claim 5, wherein said velocity plate is secured to said outer wall.

10. A continuous casting mold according to claim 5, wherein said cutout portion is shaped and proportioned so as to ensure that coolant between said velocity plate and said transition region will flow at a rate that is substantially equal to the flow rate through said slots.

11. An improved mold for a continuous casting process, comprising:

four outer walls, each of said outer walls having a plenum chamber defined in an inner surface thereof and at least one passage for communicating said plenum chamber with an external coolant conduit;

four liner walls, each of said liner walls being secured to said inner surface of one of said outer walls, said liner walls together defining a mold surface through which molten material may be passed and shaped, each of said liner walls having a number of slots defined in an inner wall thereof which, together with said outer wall, define a number of passages for transporting coolant to cool said liner during operation of said mold, at least one of said inner walls further having a recessed area defined therein; and restrictor means situated in said recessed area of said liner walls for reducing a cross-sectional area of at least one of said slots, whereby a desired distribution of coolant among said slots is achieved.

12. A mold according to claim 11, wherein said restrictor means comprises a restrictor plate that resides in said recessed area, said restrictor plate having an inner surface that is faced toward said recessed area of said liner walls and the slots therein, and an oppositely facing outer surface.

13. A mold according to claim 12, wherein said outer surface of said restrictor plate is substantially flush with said inner wall of said liner walls.

14. A mold according to claim 12, wherein each of said slots has a radiused transition portion that is proximate to a location where said slot communicates with said plenum chamber, said transition portion decreasing in cross-section near said plenum chamber, and said restrictor plate has grooves defined therein that are intended to communicate with said slots and are configured to increase in cross-section at at least one end thereof to correct for the decreasing cross-section of the slots at the transition portion, whereby a passage of nearly uniform cross-section is achieved.

15. A mold according to claim 14, further comprising a velocity plate positioned between said plenum chamber and said transition portion to limit an opening by which coolant may flow between said plenum chamber and said transition portion, said velocity plate having a tapered cutout portion defined therein in a side thereof that faces said transition portion.

16. A continuous casting mold according to claim 11, wherein said plenum chamber is an inlet plenum.

17. A continuous casting mold according to claim 11, wherein said plenum chamber is an outlet plenum.

18. A continuous casting mold according to claim 15, wherein said cutout portion is tapered to increase in width in a direction toward said opening.

19. A continuous casting mold according to claim 15, wherein said velocity plate is secured to said outer wall.

* * * * *